United States Patent [19]

Winkler et al.

[11] Patent Number: 4,570,955

[45] Date of Patent: Feb. 18, 1986

[54] ROLLER SKATE ASSEMBLY WITH AN INTERCHANGEABLE BODY

[76] Inventors: David H. Winkler; Donna K. Winkler, both of 2316 N. 29th Pl., Phoenix, Ariz. 85008

[21] Appl. No.: 565,009

[22] Filed: Dec. 23, 1983

[51] Int. Cl.[4] ..... A63C 17/02; A63C 17/14

[52] U.S. Cl. ..... 280/11.2; D21/226; 36/115; 280/1.188; 280/11.3; 280/811

[58] Field of Search ..... 280/11.3, 11.1 BR, 11.1 R, 280/11.19, 11.2, 811, 1.188; D21/226; 36/100, 101, 112, 115; 296/35.3

[56] References Cited

U.S. PATENT DOCUMENTS

| | | | |
|---|---|---|---|
| D184,650 | 3/1959 | Williams | D21/226 |
| D185,966 | 8/1959 | Williams | D21/226 |
| D232,108 | 7/1974 | Krause | 280/11.19 |
| 1,775,895 | 9/1930 | Dupuis | 280/11.19 |
| 3,738,673 | 6/1973 | Iseman | 280/11.2 |
| 4,240,132 | 12/1980 | Wickman | 280/11.2 |
| 4,294,455 | 10/1981 | Krueger | 280/11.19 |
| 4,418,929 | 12/1983 | Gray | 280/11.3 |

*Primary Examiner*—Joseph F. Peters, Jr.
*Assistant Examiner*—Everett G. Diederiks, Jr.
*Attorney, Agent, or Firm*—Harry M. Weiss & Associates

[57] ABSTRACT

An improved roller skate assembly with an interchangeable body is disclosed which comprises a roller skate, a roller skate boot, a plate positioned between the boot and the roller skate, and an interchangeable body. The plate is secured to the boot and the roller skate by nuts and bolts which fit through slots in the plate, apertures in the sole and heel of the boot and apertures in the roller skate. The interchangeable body is attached to the roller skate by pins at the front of the plate which fit into apertures located in a fastening plate attached to the front of the body and by a lip at the rear end of the body which snaps onto the rear end of the plate.

6 Claims, 7 Drawing Figures

FIG. 1
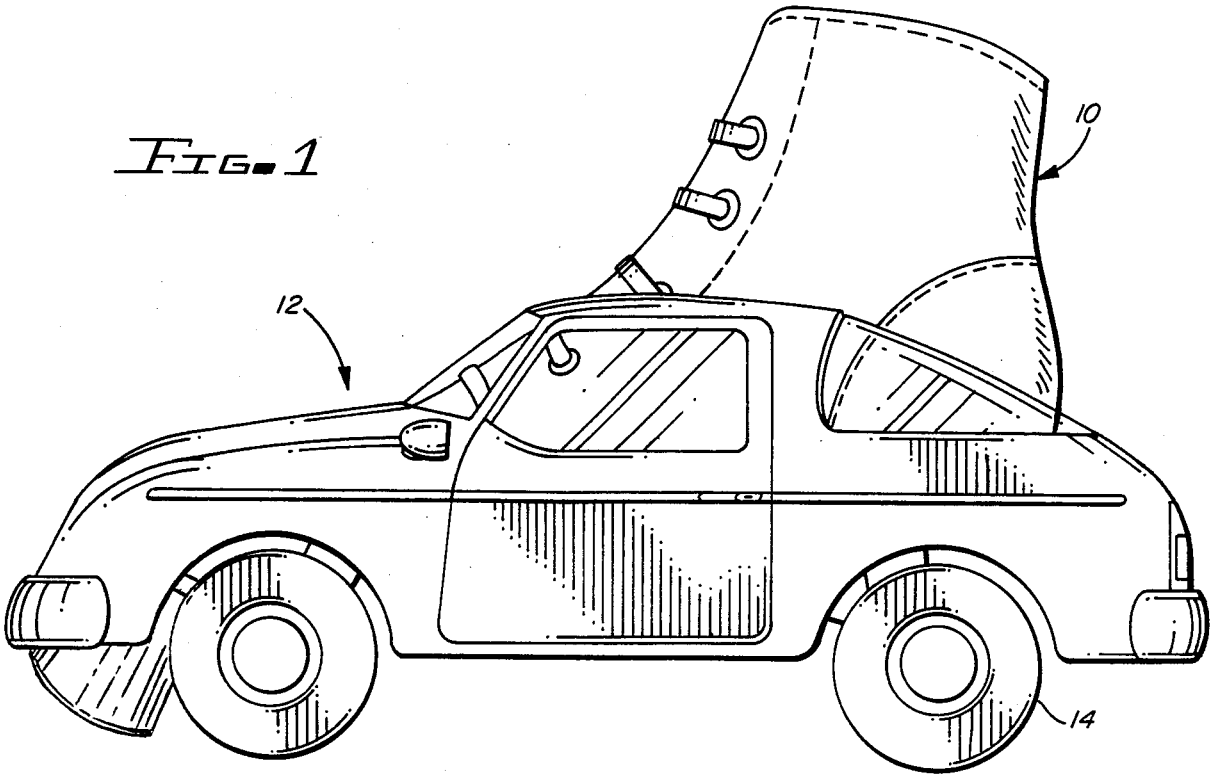
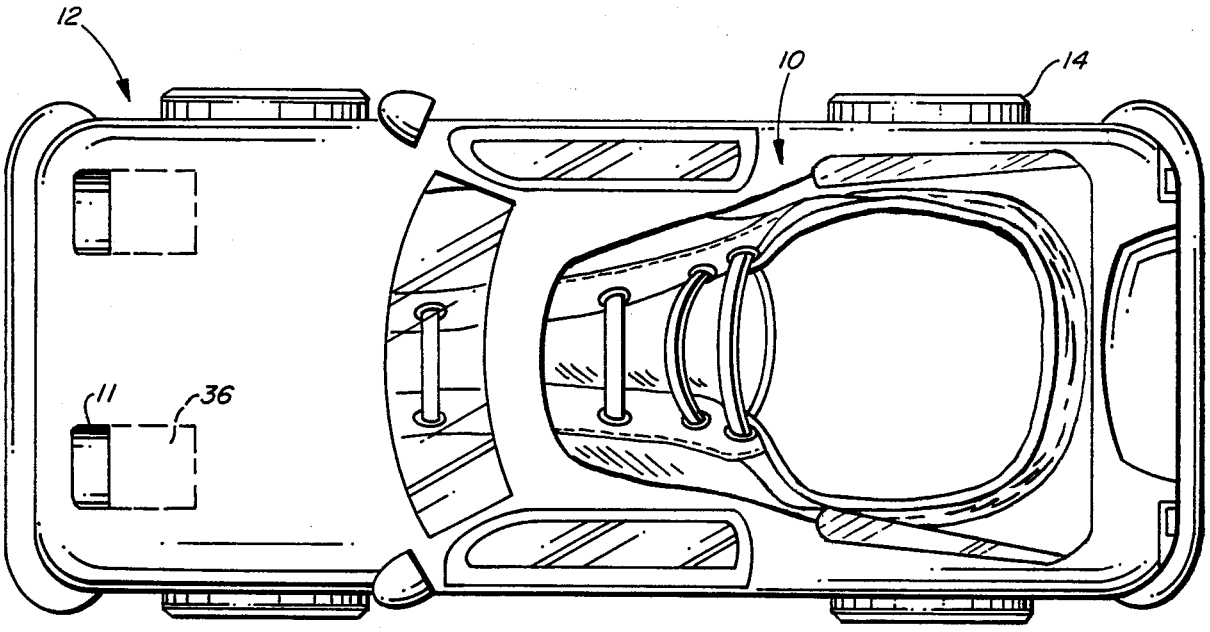
FIG. 3

ROLLER SKATE ASSEMBLY WITH AN INTERCHANGEABLE BODY

BACKGROUND OF THE INVENTION

1. Field of the Invention

This invention relates generally to roller skate assemblies and, more specifically, to a roller skate assembly with an interchangeable body which can be securely attached to a roller skate and, thereafter, removed and replaced by another interchangeable body if desired.

2. Description of the Prior Art

A variety of different roller skate configurations have been used in the past. For example, U.S. Pat. No. 1,566,706 issued to Thomas on Dec. 22, 1925 disclosed a roller skate with bracing formed to fit the shape of a shoe. The bracing consisted of elongated metal strips secured firmly to the bottom portion of the roller skate. A person's shoe was fastened to the roller skate by straps which extended from the metal bracing to the bottom of the skate. Straps were also used for the purpose of fastening a wearer's shoe to a roller skate in U.S. Pat. No. 2,535,566 issued to Collier on Dec. 26, 1950. Another assembly was disclosed in U.S. Pat. No. 1,854,188 issued to Gregory on Apr. 19, 1932. This patent described a toe clip and heel plate which were used to attach a shoe to the frame of a roller skate. However, none of the above roller skate configurations disclosed an interchangeable body which can be attached to a roller skate and, subsequently, removed and replaced by another interchangeable body if desired. In addition, none of the roller skate configurations described in the above patents adequately protected a person's shoe from dirt or debris.

A number of design patents have been issued which disclosed a variety of different roller skate bodies. Design patents which disclosed motor vehicle-type roller skate bodies include U.S. Pat. Nos. Des. 228,356 issued to Taylor on Sept. 11, 1973, 232,108 issued to Krause on July 16, 1974, and 232,110 issued to Krause on July 16, 1974. U.S. Pat. No. Des. 191,363 issued to Williams on Sept. 19, 1961 disclosed a roller skate body generally resembling a locomotive. In addition, U.S. Pat. No. Des. 185,966 issued to Williams on Aug. 25, 1959 disclosed a roller skate body which generally resembled an animal. It is important to note that none of the roller skate bodies disclosed in the design patents mentioned above were intended to be interchangeable with other roller skate bodies.

Typical roller skate configurations used today consist of a roller skate boot which is attached to a roller skate. U.S. Pat. No. Des. 220,912 issued to Sessa on June 15, 1971 disclosed such a configuration for a two-wheel "Ice Hockey Roller Skate." Contemporary four-wheel roller skates typically have a boot fastened to the supporting frame of a roller skate. The boot may be easily removed from the skate by unloosening a screw or bolt which attaches the boot to the supporting frame.

Different types of recreational activities may require participants to change the configuration of their roller skates to meet the special needs of each activity. For example, some persons may desire that their roller skates generally have the configuration of a motor vehicle while racing each other. Furthermore, different skating groups or clubs may prefer that their members wear roller skates which have a particular configuration. This may be accomplished through the use of interchangeable bodies of different configurations which may be securely attached to a roller skate. Also, the configurations of the roller skate wheels may be varied to match the different configurations of the interchangeable bodies. Each interchangeable body would fit over a roller skate boot already fastened to a skate. As a result, interchangeable bodies would protect the roller skate boots from dirt and debris which may be encountered during recreational activities. In addition, interchangeable bodies may be easily replaced if they are damaged.

Roller skating at night is hazardous because it is difficult to see the person with the roller skates. However, this problem can be minimized by attaching a light source to each roller skate. This may be accomplished by fastening a light source to an interchangeable body which has been attached to a roller skate.

Accordingly, a need exists for interchangeable bodies of various configurations, each of which can be securely attached to a roller skate and, thereafter, removed and replaced by another interchangeable body if desired. Another need exists for interchangeable roller skate wheels which will match the configuration of each interchangeable body. A further need exists for a light source which can be attached to an interchangeable body for the purpose of roller skating at night.

SUMMARY OF THE INVENTION

It is an object of this invention to provide an improved roller skate assembly with an interchangeable body.

It is another object of this invention to provide an improved roller skate assembly with an interchangeable body of variable configuration which can be securely attached to a roller skate and, thereafter, removed and replaced by another interchangeable body if desired.

It is a further object of this invention to provide an improved roller skate assembly with an interchangeable body having interchangeable roller skate wheels which match the configuration of each interchangeable body.

It is still another object of this invention to provide an improved roller skate assembly with an interchangeable body which has a light source attached to it for the purpose of roller skating at night.

In accordance with one embodiment of this invention, a roller skate assembly having an interchangeable body which may be operably secured to and removed from a roller skate fastened to a roller skate boot is disclosed which comprises a plate operably disposed between a roller skate and a roller skate boot, the plate being operably secured to the roller skate and the roller skate boot; a roller skate boot operably secured to the plate and the roller skate; a roller skate operably secured to the plate and the roller skate boot; roller skate wheels operably secured to the roller skate; and interchangeable body means for providing an interchangeable body for the roller skate assembly, the interchangeable body means having means coupled to the interchangeable body for permitting the interchangeable body to be operably secured to and removed from the plate, the roller skate and the roller skate boot. In this embodiment, a plate is operably positioned between a roller skate and a roller skate boot. The boot, plate and roller skate are fastened together by four nuts and bolts which pass through slots in the plate, apertures in the sole and heel of the boot and apertures in the roller skate. The outside configuration of the interchangeable body is substantially that of an automobile. Its structure approximates a shell. In addition, the interchangeable body has a battery pack and two cases containing bulbs at its front end for the purpose of providing a light source. The interchangeable body is attached to the roller skate by first fitting two pins attached or molded to the front end of the plate into two apertures in a fastening plate at the front of the body and then snapping a lip at the rear of the body onto the rear end of the plate.

The foregoing and other objects, features and advantages of the invention will be apparent from the following, more particular, description of the preferred embodiments of the invention as illustrated in the accompanying drawings.

BRIEF DESCRIPTION OF THE DRAWINGS

FIG. 1 is a side elevational view of a roller skate boot and an interchangeable body generally having the configuration of a motor vehicle with matching roller skate wheels, all of which are attached to a roller skate.

FIG. 3 is a top plan view of the roller skate boot, wheels and interchangeable body shown in FIG. 1.

DETAILED DESCRIPTION OF THE INVENTION

Figure 2:
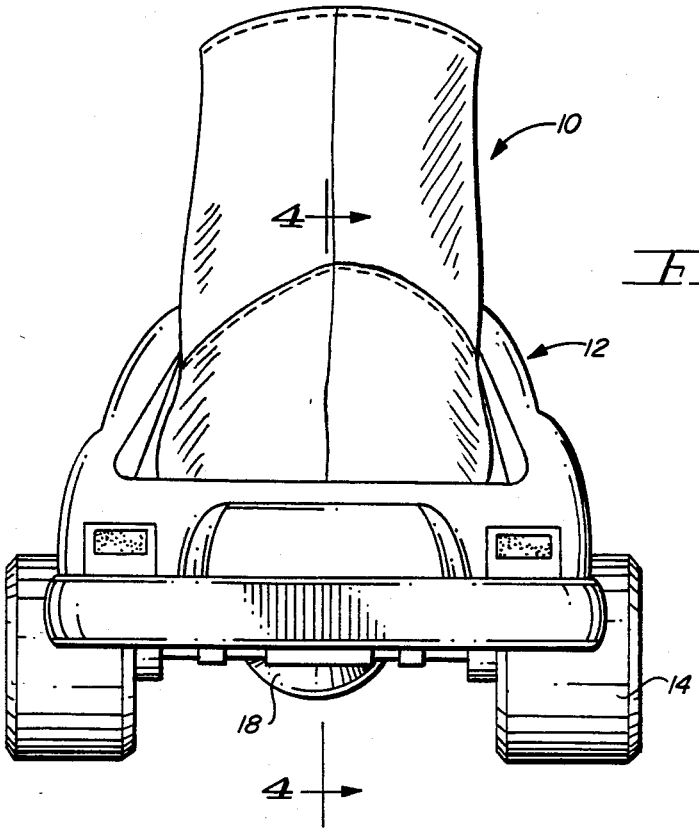
FIG. 2 is a rear elevational view of the roller skate boot, wheels and interchangeable body shown in FIG. 1.

Referring to FIG. 1, a side elevational view is shown of an interchangeable body substantially having the configuration of a motor vehicle, generally designated by reference number 12. The interchangeable body 12 is securely fastened to a roller skate (shown in FIG. 4). It fits over a roller skate boot, generally designated by reference number 10. Any type of shoe (not shown) may be substituted in place of the boot 10 if desired. The boot 10 and roller skate wheels 14 are also attached to the roller skate. The roller skate wheels 14 are preferable fabricated to match the motor vehicle configuration of the interchangeable roller skate body 12 shown in FIG. 1.

A rear elevational view is shown in FIG. 2 of the boot 10, wheels 14 and interchangeable body 12 shown in FIG. 1. FIG. 3 is a top plan view of the same parts.

Figure 4:
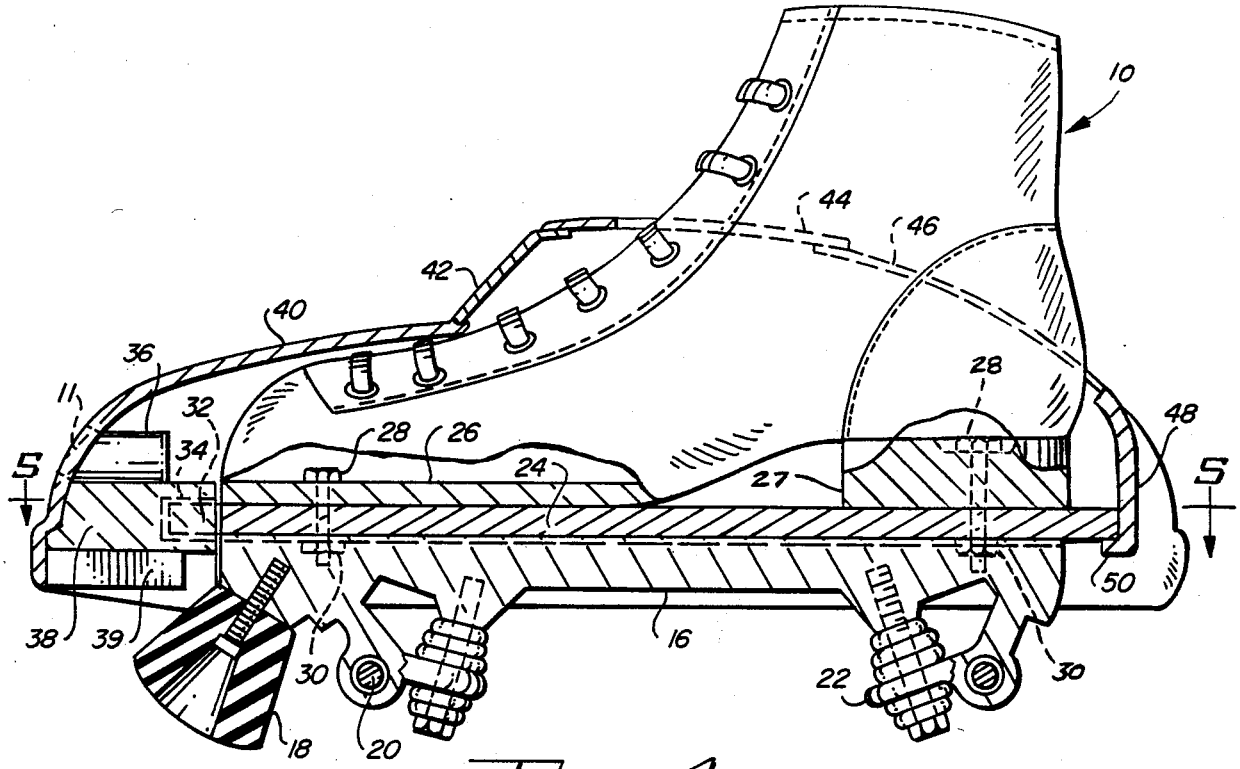
FIG. 4 is a cross sectional view taken along the line 4—4 of FIG. 2 with part of the roller skate boot broken away to show how the sole and heel of the boot are fastened to the roller skate.

FIG. 4 is a cross sectional view taken along line 4—4 of FIG. 2 with part of the boot 10 broken away to show how a sole 26 and heel 27 of the boot 10 are fastened to a roller skate frame 16 by bolts 28 and nuts 30. Axles 20 are shown which support the roller skate wheels 14. Also shown as parts of the roller skate are a toestop 18 used to stop the skate and trucks 22 used to cushion the impact of loads on the skate. A plate 24 is placed between the roller skate frame 16 and the sole 26 and heel 27 of the boot 10. The plate 24 is attached to the frame 16 by the same bolts 28 and nuts 30 which secure the sole 26 and heel 27 to the frame 16. The interchangeable roller skate body 12 is preferably made of a strong plastic material, or the like. The body shell of the interchangeable body 12, shown in FIG. 4, includes a front portion 40, top portion 44 and rear portion 48. A windshield 42 and a rear window 46 are also shown. A fastening member 38 has two apertures 34 (see FIG. 5). Note that the fastening member 38 is attached to the plate 24 by pressing two pins 32 (see FIG. 5) attached to the plate 24 (preferably molded as part of the plate) into the apertures 34. The rear portion 48 of the body shell is attached to the plate 24 by a lip 50. It is important to note that the interchangeable body 12 is attached to the roller skate by first pressing the pins 32 into the apertures 34 and then snapping the rear portion 48 of the body shell onto the plate 24 using the lip 50.

Referring to FIGS. 3 and 4, two openings 11 in the front portion 40 of the body shell are shown. These openings 11 are for light produced by bulbs (not shown) contained in cases 36. The bulbs are illuminated by batteries (not shown) contained in a battery pack 39.

Figure 5:
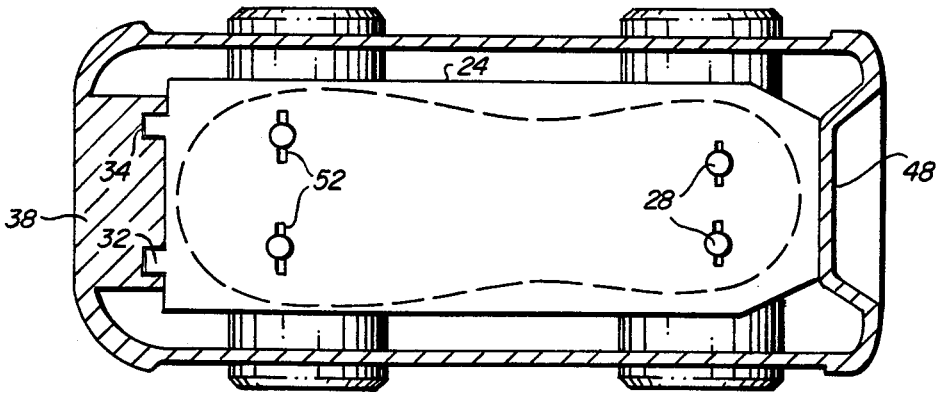
FIG. 5 is a cross sectional view taken along the line 5—5 of FIG. 4 showing the bottom of the roller skate boot in dotted form.

FIG. 5 is a cross sectional view taken along the line 5—5 shown in FIG. 4. Note that the bottom of the roller skate boot 10 is shown in dotted form. Elongated slots 52 through the plate 24 are provided in order to simplify the procedure for fastening boots of different widths to the roller skate. While the invention has been particularly shown and described in reference to the preferred embodiments thereof, it will be understood by those skilled in the art that changes in the form and details may be made therein without departing from the spirit and scope of the invention.

Figure 6:
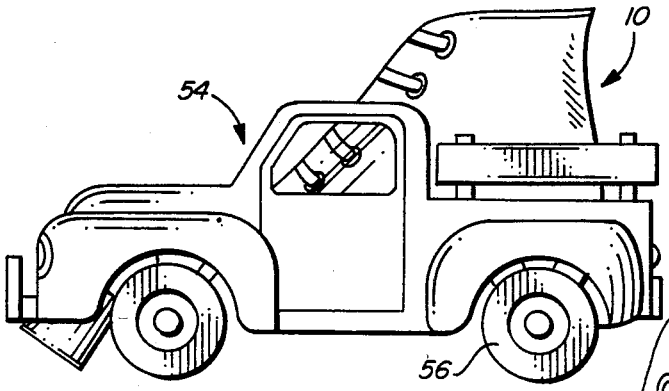
FIG. 6 is a side elevational view of a roller skate boot and another interchangeable body generally having the configuration of a motor vehicle with matching roller skate wheels, all of which are attached to a roller skate.
Figure 7:
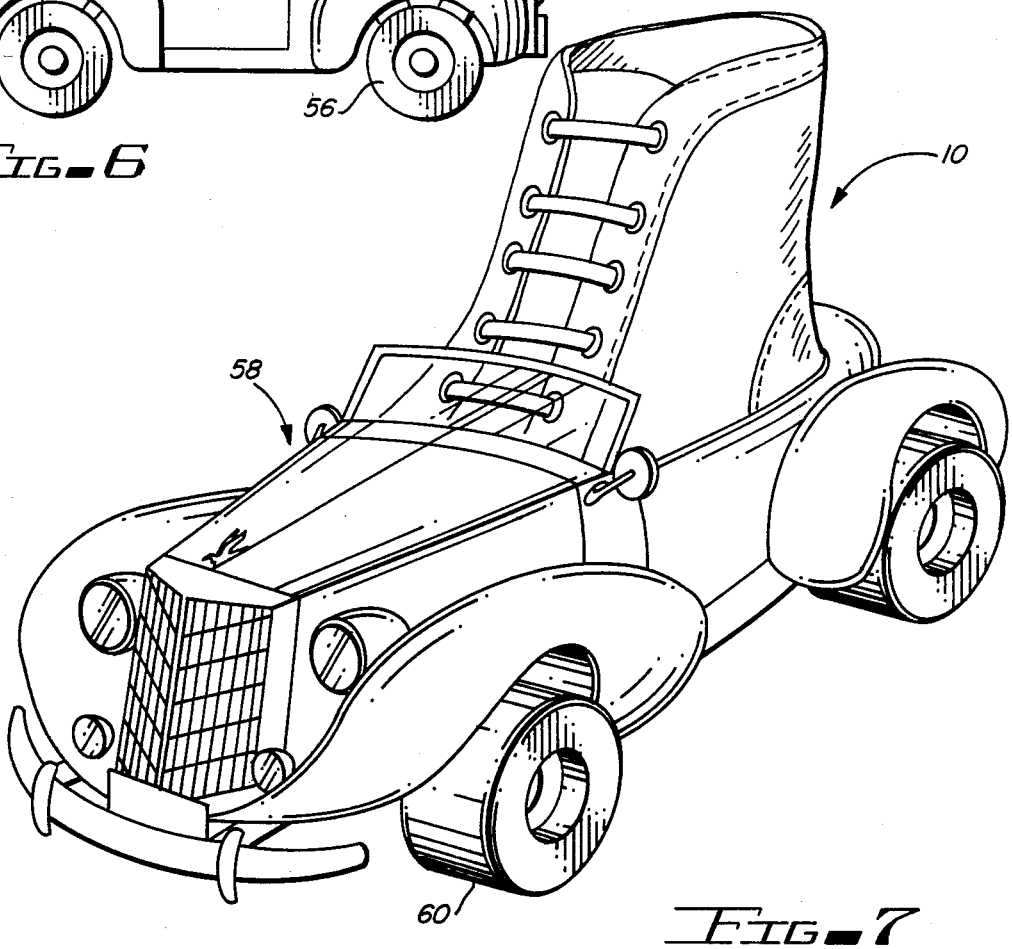
FIG. 7 is a perspective view of a roller skate boot and still another interchangeable body generally having the configuration of a motor vehicle with matching roller skate wheels, all of which are attached to a roller skate.

FIGS. 6 and 7 show two additional versions of interchangeable bodies 54 and 58. Roller skate wheels 56 and 60 may be fabricated to match each configuration.

We claim:

1. A roller skate assembly having a roller skate, a roller skate boot, and an interchangeable body which may be operably secured to and removed from said roller skate comprising, in combination:

a generally rectangular shaped plate, having tapered corners at its rear end, a plurality of pins attached to the front end of said plate, and having a plurality of elongated apertures passing therethrough, operably disposed between said roller skate and said roller skate boot;

a plurality of aligned elongated aperatures passing through each of said roller skate, said roller skate boot, and said plate;

a plurality of attachment means which cooperate with said plurality of aligned elongated aperatures for removably coupling said roller skate boot, said plate, and said roller skate;

an interchangeable body for said roller skate assembly, said interchangeable body further comprising:

a shell structure, said shell structure further having a plurality of openings therein;

fastening means attached to the front end of said interchangeable body for removably coupling to said pins of said plate and a protruding member having a lip, attached to a rear inner surface of said interchangeable body, for removably coupling said interchangeable body to a rear end of said plate; and roller skate wheels operably secured to said roller skate.

2. The roller skate assembly of claim 1 wherein said shell structure has an outside configuration substantially resembling that of an automobile.

3. The roller skate assembly of claim 1 wherein said interchangeable body further comprises battery pack means attached to a bottom surface of said fastening means.

4. The roller skate assembly of claim 1 wherein said interchangeable body further comprises a plurality of cases, received within said plurality of openings in said shell structure, said cases being attached to a top surface of said fastening means and being operably coupled to illuminating means for providing light, through said plurality of openings, in a generally forward direction.

5. The roller skate assembly of claim 1 wherein said roller skate wheels have automobile wheel-shaped configurations.

6. A roller skate assembly having a roller skate, a roller skate boot, and an interchangeable body which may be operably secured to and removed from said roller skate comprising, in combination:

a plurality of apertures through a sole and a heel of said roller skate boot;

a generally rectangular shaped plate having tapered corners at its rear end and having a plurality of elongated apertures passing therethrough being oriented in such a manner as to be in alignment with said plurality of apertures in said sole and heel of said roller skate boot, said plate further having a plurality of pins attached to a front end thereof;

a plurality of apertures through said roller skate being oriented in such a manner as to be in alignment with said plurality of apertures in said sole and heel of said roller skate boot and said plurality of elongated apertures in said plate;

said plate being operably secured between said roller skate and said roller skate boot by a plurality of nuts and bolts which removably attach said roller skate boot, said plate, and said roller skate, said plurality of nuts and bolts removably received within said apertures in said sole and heel of said roller skate and passing therethrough, removably received within said elongated apertures in said plate and passing therethrough and removably received within said apertures in said roller skate and passing therethrough;

an interchangeable body having a plurality of openings passing through a front end thereof, said interchangeable body further comprising a generally rectangular shaped fastening means coupled to a front surface of said interchangeable body for permitting said interchangeable body to be operably secured to and removed from said plate, said interchangeable body further having a battery pack means attached to a bottom surface of said fastening means for providing electricity and a plurality of cases attached to a top surface of said fastening means, said cases containing illuminating means and being removably received within said plurality of openings in said interchangeable body, said cases being orientated in said plurality of openings in such a manner as to provide illumination in a generally forward direction, said interchangeable body further having an inner rear protruding member having a lip for removably engaging said generally rectangular shaped plate; and roller skate wheels operably secured to said roller skate.

* * * * *